US006939841B2

(12) United States Patent
Requejo

(10) Patent No.: US 6,939,841 B2
(45) Date of Patent: Sep. 6, 2005

(54) EFFERVESCENT COMPOSITIONS

(75) Inventor: Luz P. Requejo, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 381 days.

(21) Appl. No.: 10/301,273

(22) Filed: Nov. 21, 2002

(65) Prior Publication Data

US 2004/0102341 A1 May 27, 2004

(51) Int. Cl.[7] ..... C11D 77/04; C11D 17/00; C11D 17/06

(52) U.S. Cl. ..... 510/446; 510/191

(58) Field of Search ..... 510/191, 446

(56) References Cited

U.S. PATENT DOCUMENTS

| | | | |
|---|---|---|---|
| 4,522,738 | A | 6/1985 | Magid et al. |
| 5,031,253 | A | 7/1991 | Brendlinger |
| 5,041,421 | A | 8/1991 | King |
| 5,114,647 | A | 5/1992 | Levesque et al. |
| 5,443,656 | A | 8/1995 | Burrows et al. |
| 5,578,562 | A | 11/1996 | Lockhart |
| 5,718,729 | A | 2/1998 | Harris |
| 5,885,949 | A | 3/1999 | Stamm |
| 5,888,544 | A | 3/1999 | Gergely et al. |
| 5,910,477 | A | 6/1999 | Gordon |
| 5,958,334 | A | 9/1999 | Haddon |
| 6,001,789 | A | 12/1999 | Trinh et al. |
| 6,054,423 | A | 4/2000 | McGill |
| 6,057,281 | A | 5/2000 | Stamm |
| 6,063,390 | A | 5/2000 | Farrell |
| 6,121,215 | A | 9/2000 | Rau |
| 6,180,092 | B1 | 1/2001 | Lagin |
| 6,197,338 | B1 | 3/2001 | Nürnberg et al. |
| 6,255,267 | B1 | 7/2001 | Nayar et al. |
| 6,355,607 | B1 | 3/2002 | Rahman et al. |
| 6,387,321 | B1 | 5/2002 | McGill |
| 2002/0061831 | A1 | 5/2002 | Kaziska et al. |
| 2002/0132746 | A1 | 9/2002 | Desenna et al. |

FOREIGN PATENT DOCUMENTS

| | | |
|---|---|---|
| EP | 0752 466 A1 | 1/1997 |
| EP | 1 035 198 A2 | 9/2000 |
| WO | WO93/05136 | 3/1993 |

*Primary Examiner*—Yogendra N. Gupta
*Assistant Examiner*—John M Petruncio

(57) ABSTRACT

Effervescent compositions are disclosed. The effervescent composition may include at least one compound capable of effervescence in the presence of a liquid, such as water. The effervescent composition may also include a non-hygroscopic solvent. The presence of the non-hygroscopic solvent may assist the effervescent composition in substantially avoiding effervescence until the composition contacts a liquid. Optionally, the ratio of the at least one compound capable of effervescence to the non-hygroscopic solvent is not less than 9:1.

40 Claims, No Drawings

EFFERVESCENT COMPOSITIONS

FIELD OF THE INVENTION

This invention relates generally to effervescent compositions, and more particularly to effervescent compositions useful in toilets.

SUMMARY OF THE INVENTION

Effervescent compositions and methods for using and making effervescent compositions are disclosed.

In one embodiment, the effervescent composition of the present invention is capable of being inserted into a liquid. The effervescent composition includes at least one compound and is capable of effervescence in the presence of moisture. The effervescent composition further includes a non-hygroscopic solvent.

In another embodiment, a method for controlling effervescence comprises the steps of providing a composition comprising at least one compound, the composition capable of effervescence in the presence of moisture, providing a non-hygroscopic solvent, and substantially avoiding effervescence by the composition until the composition contacts a liquid.

In yet another embodiment, a method for making an effervescent composition comprises the steps of providing a composition comprising at least one compound, the composition capable of effervescence in the presence of moisture, wherein the composition substantially avoids effervescence by the composition until the composition contacts a liquid, and providing a non-hygroscopic solvent.

DETAILED DESCRIPTION

The effervescent of the present invention comprises a composition that is capable of effervescence and a non-hygroscopic solvent. The effervescent may optionally include other components. Regardless of the inclusion of these other components, however, the term "effervescent," as defined herein, means any product capable of forming bubbles in liquid environments and may also be considered any product capable of liberating carbon dioxide in or out of liquid environments. Likewise, "effervescence" means forming bubbles in liquid environments or liberating carbon dioxide in or out of liquid environments.

In certain embodiments, the presence of bubbles results from the formation of carbon dioxide. For instance, when added to a liquid, such as water, a mixture of at least one acid and at least one salt results in a chemical reaction that liberates carbon dioxide. In one aspect, both the acid and the salt may be in anhydrous form.

Examples of acids suitable for use in these illustrative embodiments include, but are not limited to, tartaric acid, citric acid, fumaric acid, adipic acid, malic acid, oxalic acid, or sulfamic acid, either alone or in combination. Typically, the effervescent of these embodiments is prepared from citric acid or a combination of citric acid and tartaric acid. Use of citric acid alone may cause difficulties during the manufacturing process. For example, use of citric acid alone may result in a sticky mixture that is difficult to granulate.

Examples of salts suitable for use in illustrative embodiments include, but are not limited to, the alkali metal salts. Sodium carbonate, calcium carbonate, magnesium carbonate, ammonium carbonate, potassium carbonate, sodium bicarbonate, and calcium bicarbonate may all be employed.

In other embodiments, the selection of specific acids and/or salts and their proportions depends, at least in part, upon the requirements for the amount of carbon dioxide release. In some embodiments, the acid may be added in an amount of about 10% to about 60% by weight of the effervescent, while the salt may also be added in an amount of about 10% to 60% by weight of the effervescent.

The effervescent of the present invention also includes a non-hygroscopic solvent, which in select embodiments, may be added to the effervescent in an amount of up to 10% by weight of the effervescent. Thus, the acid/salt component of these embodiments comprises 90% or more of the final formulation, and the ratio of the acid/salt component to the non-hygroscopic solvent is not less than 9:1. If the ratio of the acid/salt component to the non-hygroscopic solvent falls below 9:1 the final formulation may form a sticky mixture or slurry.

The term non-hygroscopic solvent is defined herein as any compound that does not take up moisture from the environment. Since neither the effervescent nor the non-hygroscopic solvent absorb moisture, the formation of bubbles should be substantially avoided until the effervescent is contacted by a liquid, such as water. That is, moisture from the environment does not precipitate a premature reaction between the acid and salt of the effervescent, before these chemical constituents come into contact with liquids.

In some embodiments, the non-hygroscopic solvent is capable of dissolving or dispersing at least a small amount of one or more other substances. Such non-hygroscopic solvents include, but are not limited to diethyl phthalate, isopropyl myristate, isopropyl palmitate and at least some species of ester solvents, such as dioctyl adipate and butyl stearate.

In other embodiments, the non-hygroscopic solvent may be non-aqueous or non-polar (aprotic). With respect to the non-aqueous aspect, the absence of water from the effervescent substantially avoids the formation of bubbles until the effervescent is contacted by a liquid. Regarding the absence of polarity, this feature avoids dissociation of the salt of the effervescent, which under certain circumstances, may trigger a premature reaction between the acid and carbonate or bicarbonate components of the effervescent.

In still other embodiments, the effervescent further includes a fragrance and/or perfume. In these embodiments, the fragrance may be released into the atmosphere through the formation of carbon dioxide. The fragrance is typically present in an amount of up to about 6% by weight of the effervescent.

Any known fragrance and/or perfume may be employed. Such fragrances include, but are not limited to, Allspice, Balsam, Bouquet, Christmas Pine, Citronella, Citrus Fresh, Citrus 7305 & 7309, Clean & Fresh, Cove, Deodorizer, Earth & Sea, Eucalyptus, Evergreen, any of the Floral series (3788, 9451, 8444, 4788, 9436 & 9940), Fresh & Clean 7902 & 8003, Fresh Outdoors, Gardenia, any of the Herbal series (8916, 4555, 8144 & 3719), Honeysuckle, Jasmin, any of the Lemon series (6001, 6039, 8136, 9413 & 9414), any of the Odor Mask series (5211, 6794, 7851, 8833, 8836, 8838, 8839, 8899 & 8899 w/s), any of the Pine series (9434, 8329 & 9435), Rose (9297 & 9298), Sandalwood, Sea Breeze, Spring Clean and Spring Rain, all available from The Good Scents Company, Atlanta, Ga.

Other fragrances and/or perfumes useful in the practice of the invention include the fragrances commonly used in the household and industrial cleaning and sanitizing industry. These fragrances may be found in the catalog Flavors &

Fragrances, and are available from the Aldrich Chemical Company, Inc., Milwaukee, Wis. Those of particular interest are Alpha Pinene, Alpha Terpineol, Beta Pinene, Cedar Leaf, Citral, Citronellal W23070-7, Coumarin, Diethylphthalate, Eucolyptol, Eugenol, Heptyl Isobutyrate, Trans-2-Hexene-Diol, Isobornyl and 3,5,5-Trimehtylhexanal.

Often, but not always, the fragrance contains the non-hygroscopic solvent. In these embodiments, the non-hygroscopic solvent may be present in an amount of up to 25% by weight of the fragrance or up to 1.5% by weight of the effervescent.

As those of skill will appreciate, fragrances typically comprise highly concentrated solid ingredients. The presence of the non-hygroscopic solvent may be necessary to dissolve, disperse or mix these solid ingredients to make the fragrance homogenous throughout the effervescent. Since fragrance manufacturers often incorporate solvents directly into their fragrances, coordinating solvent selection with the fragrance manufacturer may be necessary.

The effervescent may further include a colorant. The colorant may be oil- or water-soluble, and typically is an anhydrous powder dye. The amount of colorant to be used may depend on the color intensity desired and the cost of the dye, and may be added at levels up to about 2.5% by weight of the effervescent.

The choice of the colorant will depend largely on the color desired for the water into which the effervescent is to be dispensed. Examples of suitable water-soluble colorants include, but are not limited to, acid blue # 9, Basacid Blue NB 755®, FD&C yellow #5, FD&C Red #33, and D&C Green #8. Oil-soluble colorants include, but are not limited to, Nitro Fast Red A 4B®, solvent yellow 72 and Sandoplast Green G®.

In addition, the effervescent may further include a surfactant. A surfactant is any substance capable of reducing surface tension, no matter how slight, between phases. Similar to the colorant, the surfactant is typically added in anhydrous form. In some embodiments, the surfactant may be added to the effervescent at levels ranging from about 0.25% to about 10% by weight of the effervescent. In other embodiments, the surfactant imparts a detergent effect to the effervescent.

Surfactants useful in the effervescent of the present invention include anionic, non-ionic, cationic, amphoteric and zwitterionic surfactants. Anionic surfactants are particularly useful, since such surfactants are capable of forming a thick foam or lather during liberation of carbon dioxide by the effervescent.

Examples of suitable surfactants include, but are not limited to sodium lauryl sulfonate, sodium alpha olefin sulfonate, alkyl benzene sulfonate, sodium dodecyl benzene sulphonate and cocoyl glutamic acid. Other types of surfactants include alkyl benzene sulfonates, alkyl ether sulfates, paraffin, sulfonates, olefin sulfonates, amine oxides, alkyl betaines and the like, which are known in the art. Commercial sources of such surfactants may be found in McCutcheon's Emulsifiers and Detergents, North American Edition, 1987, McCutcheon Division, (MC Publishing Company).

An absorbing agent may also be added to the effervescent of the present invention, in an amount of about 0.1% to about 10% by weight of the effervescent. The absorbing agent is useful for taking up moisture that may come into contact with the effervescent, thereby preventing the premature reaction between the acid and carbonate or bicarbonate components of the effervescent.

The absorbing agent is typically a compound comprising silica (silicon dioxide). Examples of such absorbing agents, include but are not limited to, amorphous silica, foamed silica and synthetic silica.

In other aspects, the invention involves methods of making the effervescent described herein. In illustrative embodiments, the effervescent may be prepared in a V-blender or a ribbon blender.

If a V-blender is employed, in one embodiment, a salt is pre-mixed with a non-hygroscopic solvent, and then poured into to the blender. Addition of citric acid to the blender follows. Mixing of the compounds for approximately fifteen minutes occurs. In another embodiment, a fragrance containing a non-hygroscopic solvent and a salt are pre-mixed, and then added to the V-blender. A surfactant may then be added to the blender, followed by mixing until substantially homogeneous. Citric acid, a flowing agent and a dye may be added next, with additional mixing until substantially homogeneous.

A ribbon blender may also be employed. This processing method is faster and more efficient. In embodiments using a ribbon blender, the chemical constituents may be added simultaneously, followed by mixing. Alternatively, a fragrance containing a non-hygroscopic solvent may be sprayed into the ribbon blender during the mixing process.

Regardless of the type of blender employed, external conditions, such as temperature and humidity, should be monitored throughout the process of making the effervescent. Ideally, manufacture of the effervescent is carried out at temperatures between about 20° C. and 30° C. and at lower relative humidities, up to 40% for example.

Typically, the above-described method of making yields the effervescent of the present invention in powder form. The effervescent may, however, be supplied in various other forms, such as tablet form, block form, cake form, capsule form, and any other form known to those of skill in the art. To make tablet, block or cake forms, the powder form may be compressed by methods known to those of skill in the art. Size and hardness are dependent on the mold size and pressure used during the compression process. If a liquid form is desired, in some cases it is necessary to employ a dual bottle with two compartments to separate salt and acid.

In other embodiments, the effervescent of the present invention is capable of being inserted into all toilets, either before or after use to sanitize or control odors. This includes toilets found in all settings with and without water holding tanks. The invention may also be used to sanitize or control odor in waste water systems.

Odor control may be achieved through certain embodiments of the present invention, and in one aspect is related to the formation of carbon dioxide gas. That is, some malodors have high molecular weights and therefore cannot rise to the surface of an aqueous environment to escape into the atmosphere before carbon dioxide. Thus, in embodiments of the present invention that emit carbon dioxide, odors with high molecular weights are suppressed. Other malodors have low molecular weights and escape out of an aqueous environment and into the atmosphere before carbon dioxide. Odors with low molecular weights, may also be controlled by the present invention, through embodiments that comprise a fragrance. The presence of the fragrance helps mask malodors as they rise to the surface of the toilet water and after they are released into the environment.

In other embodiments, the various forms of the effervescent may be contained in a reagent vessel. A reagent vessel is capable of containing or holding the effervescent of the present invention. For example, the reagent vessel may be a sealed pouch, dissolvable in water. In such embodiments, the reagent vessel may be constructed from a permeable filter paper-like material (e.g. the material used in tea bags). This type of material permits the components to leave the reagent vessel after insertion into the toilet so that the components may react in the toilet water.

The reagent vessel may also be constructed of foil, plastic or any other type of material that will hold the effervescent before insertion into a toilet. Such materials include, but are not limited to polyethylene, polypropylene, polystyrene and polyethylene-terephtalate. In these embodiments, the reagent vessel may be discarded prior to insertion of the effervescent into the toilet. For instance, the various forms of the effervescent may be packaged in a single use package, which may be carried in one's purse or pocket. When using a public restroom or a friend's bathroom, the user may open the package containing the effervescent of the present invention, and dispense the contents into the toilet.

When the effervescent of the present invention is contained within a reagent vessel, it is particularly useful to substantially avoid bubbling by the effervescent until it contacts a liquid. More specifically, when bubbling results in carbon dioxide formation, the presence of carbon dioxide gas may exert pressure on the reagent vessel causing it to explode and prematurely release its contents before being inserted into a toilet. Under these circumstances, the effervescent may be rendered unusable and/or potentially injure the user.

In still other embodiments, a dispensing apparatus for delivering the effervescent of the present invention into a toilet may be employed. The dispensing apparatus may, for example, be attached to any solid surface on or above a toilet and may comprise a container connected to a tube or other device for delivering the effervescent from the container into the toilet bowl or tank. The dispensing apparatus may be operated by depressing a button or any other suitable means that will dispense appropriate amounts of effervescent.

The present invention is illustrated, but in no way limited by the following examples, in which added constituents are reflected in terms of % addition, with the unaccounted-for remainder comprising inert ingredients:

EXAMPLES 1a–b

Ex. 1a: 40.0% sodium bicarbonate was pre-mixed with 4.0% of a Citrus Fresh fragrance containing diethyl phthalate. This mixture was then placed into to a V-blender. 1.0% of sodium lauryl sulfonate was added to the V-blender, followed by mixing until substantially homogeneous. 40.0% citric acid, 0.5% amorphous silica and 0.0025% acid blue # 9 were then added, with additional mixing until substantially homogeneous.

Ex. 1b: 40.0% sodium bicarbonate, 4.0% of an Evergreen fragrance containing isopropyl myristate, 1.0% sodium alpha olefin sulfonate, 40.0% of a citric and tartaric acid mix, 0.5% amorphous silica and 0.0025% Sandoplast Green® were simultaneously added to a ribbon blender. The contents of the ribbon blender underwent mixing until substantially homogeneous.

The final formulations of Examples 1a–b were observed at room temperature for premature effervescence, and then inserted into an aqueous environment. Neither of the formulations bubbled until they contacted the aqueous environment.

The formulations were also tested in homes, and generated high consumer interest and excitement. According to consumer feedback, these were the only formulations that effectively eliminated sulfide and amine type malodors caused by human waste. This feature is based on the combination of the formulations' effervescent action and incorporation of a pleasant fragrance.

Comparative Example 40.0% sodium bicarbonate was pre-mixed with 4.0% of a Citrus Fresh fragrance containing diethylene glycol monomethyl ether, which is a hygroscopic solvent. This mixture was then placed into to a V-blender. 1.0% sodium lauryl sulfonate was added to the V-blender, followed by mixing until substantially homogeneous. 40.0% citric acid, 0.5% amorphous silica and 0.025% acid blue # 9 were then added, with additional until substantially homogeneous.

This formulation was also tested by observing it at room temperature over time for premature effervescence. In contrast to the formulations of Examples 1a–b, this formulation began premature effervescence without contacting a liquid. If this formulation is packaged in a tightly sealed container, such container will likely balloon and/or explode over time.

Variations, modifications and other implementations of what is described herein will occur to those of ordinary skill in the art without departing from the spirit and scope of the invention. Accordingly, the invention is in no way limited by the preceding illustrative description.

I claim:

1. A process for controlling effervescence comprising:

providing a composition comprising at least one compound, selected from both an acid and a carbonate or bicarbonate salt; the composition capable of effervescence in the presence of moisture;

providing a non-hygroscopic solvent selected from the group consisting of diethyl phthalate, isopropyl myristate, isopropyl palmitate, dioctyl adipate and butyl stearate; and substantially avoiding effervescence caused by the formation of carbon dioxide by the composition until the composition contacts a liquid.

2. The process of claim 1, wherein the acid is citric acid and the salt is an alkali metal carbonate.

3. The process of claim 1, wherein the non-hygroscopic solvent is anhydrous.

4. The process of claim 1, wherein the composition and the non-hygroscopic solvent are mixed.

5. The process of claim 1, wherein the liquid is water.

6. The process of claim 1, further comprising providing a fragrance.

7. The process of claim 6, wherein the fragrance comprises the non-hygroscopic solvent.

8. The process of claim 1, further comprising providing a colorant.

9. The process of claim 1, further comprising providing a surfactant.

10. The process of claim 1, further comprising providing an absorbing agent.

11. The process of claim 1, wherein the composition comprising at least one compound and the non-hygroscopic solvent are contained in a reagent vessel.

12. The process of claim 1, wherein the composition comprising at least one compound and the non-hygroscopic solvent are in tablet form.

13. The process of claim 1, further comprising inserting the composition comprising at least one compound and the non-hygroscopic solvent into a toilet.

14. The process of claim 1, wherein the ratio of the composition to the non-hygroscopic solvent is not less than 9:1.

15. An effervescent comprising:

a composition comprising at least one compound selected from both an acid and a carbonate or bicarbonate salt and capable of effervescence in the presence of moisture, wherein effervescence by the composition caused by the formation of carbon dioxide is substantially avoided until the composition contacts a liquid; and a non-hygroscopic solvent selected from the group consisting of diethyl phthalate, isopropyl myristate, isopropyl palmitate, dioctyl adipate and butyl stearate.

16. The effervescent of claim 15, wherein the composition and the non-hygroscopic solvent are mixed in a reagent vessel.

17. The effervescent of claim 16, wherein the reagent vessel is capable of dissolving in water.

18. The effervescent of claim 16, wherein the reagent vessel is a sealed pouch.

19. The effervescent of claim 15, wherein the acid is citric acid and the salt is an alkali metal carbonate.

20. The effervescent of claim 15, wherein the non-hygroscopic solvent is anhydrous.

21. The effervescent of claim 15, wherein the non-hygroscopic solvent is non-polar.

22. The effervescent of claim 15, further comprising a fragrance.

23. The effervescent of claim 22, wherein the fragrance comprises the non-hygroscopic solvent.

24. The effervescent of claim 15, further comprising a colorant.

25. The effervescent of claim 15, further comprising a surfactant.

26. The effervescent of claim 15, further comprising an absorbing agent.

27. The effervescent of claim 15, wherein the ratio of the composition to the non-hygroscopic solvent is not less than 9:1.

28. A process for making an effervescent comprising:

providing a composition comprising at least one compound, selected from both an acid and a carbonate or bicarbonate salt the composition capable of effervescence in the presence of moisture and wherein the composition substantially avoids effervescence caused by the formation of carbon dioxide until the composition contacts a liquid; and providing to the composition a non-hygroscopic solvent selected from the group consisting of diethyl phthalate, isopropyl myristate, isopropyl palmitate, dioctyl adipate and butyl stearate.

29. The process of claim 28, wherein the acid is citric acid and the salt is an alkali metal carbonate.

30. The process of claim 28, wherein the non-hygroscopic solvent is anhydrous.

31. The process of claim 28, wherein the non-hygroscopic solvent is non-polar.

32. The process of claim 28, wherein the liquid environment is water.

33. The process of claim 28, further comprising providing a fragrance.

34. The process of claim 33, wherein the fragrance comprises the non-hygroscopic solvent.

35. The process of claim 28, further comprising providing a colorant.

36. The process of claim 28, further comprising providing a surfactant.

37. The process of claim 28, further comprising providing an absorbing agent.

38. The process of claim 28, further comprising placing the composition comprising at least one compound and the non-hygroscopic solvent in a reagent vessel.

39. The process of claim 28, further comprising pressing the composition comprising at least one compound and the non-hygroscopic solvent into tablet form.

40. The process of claim 28, wherein the ratio of the composition to the non-hygroscopic solvent is not less than 9:1.

* * * * *